United States Patent [19]

Olofsson

[11] 4,350,078

[45] Sep. 21, 1982

[54] APPARATUS FOR RESTRICTING THE VELOCITY OF A HYDRAULIC PISTON IN ITS END POSITIONS

[75] Inventor: Bertil R. Olofsson, Eslöv, Sweden

[73] Assignee: Akermans Verkstad AB, Eslöv, Sweden

[21] Appl. No.: 108,084

[22] Filed: Dec. 28, 1979

[30] Foreign Application Priority Data

Jan. 2, 1979 [SE] Sweden ..... 7900014

[51] Int. Cl.[3] ..... F15B 13/16

[52] U.S. Cl. ..... 91/388; 91/461

[58] Field of Search ..... 91/388, 461

[56] References Cited

U.S. PATENT DOCUMENTS 2,974,639 3/1961 O'Connor et al. ..... 91/388

3,872,773 3/1975 Denker ..... 91/388

FOREIGN PATENT DOCUMENTS 1165612 10/1969 United Kingdom ..... 91/388

1408607 10/1975 United Kingdom ..... 91/388

*Primary Examiner*—Paul E. Maslousky

*Attorney, Agent, or Firm*—Blair, Brown & Kreten

[57] ABSTRACT

An apparatus for restricting the velocity of movement of the piston of a servo-controlled operating hydraulic unit, when the piston approaches at least its one end position in the cylinder, by means of a hydraulic sensor fixedly mounted on one of the machine parts which is shifted with respect to each other by means of the operating hydraulic unit, and is coupled by the intermediary of a non-return valve to the servo-circuit. When the piston of the operating hydraulic unit approaches its end position in the cylinder, the hydraulic sensor is actuated by the second of the above-mentioned machine parts, whereby a pressure is established in the cylinder of the hydraulic sensor which exceeds the servo-pressure. A valve senses the pressure difference between the servo-pressure and the pressure established by means of the hydraulic sensor and throttles the servo-flow to the main valve of the operating hydraulic unit the main valve thereby throttling the pressure medium supply to the operating hydraulic unit.

3 Claims, 1 Drawing Figure

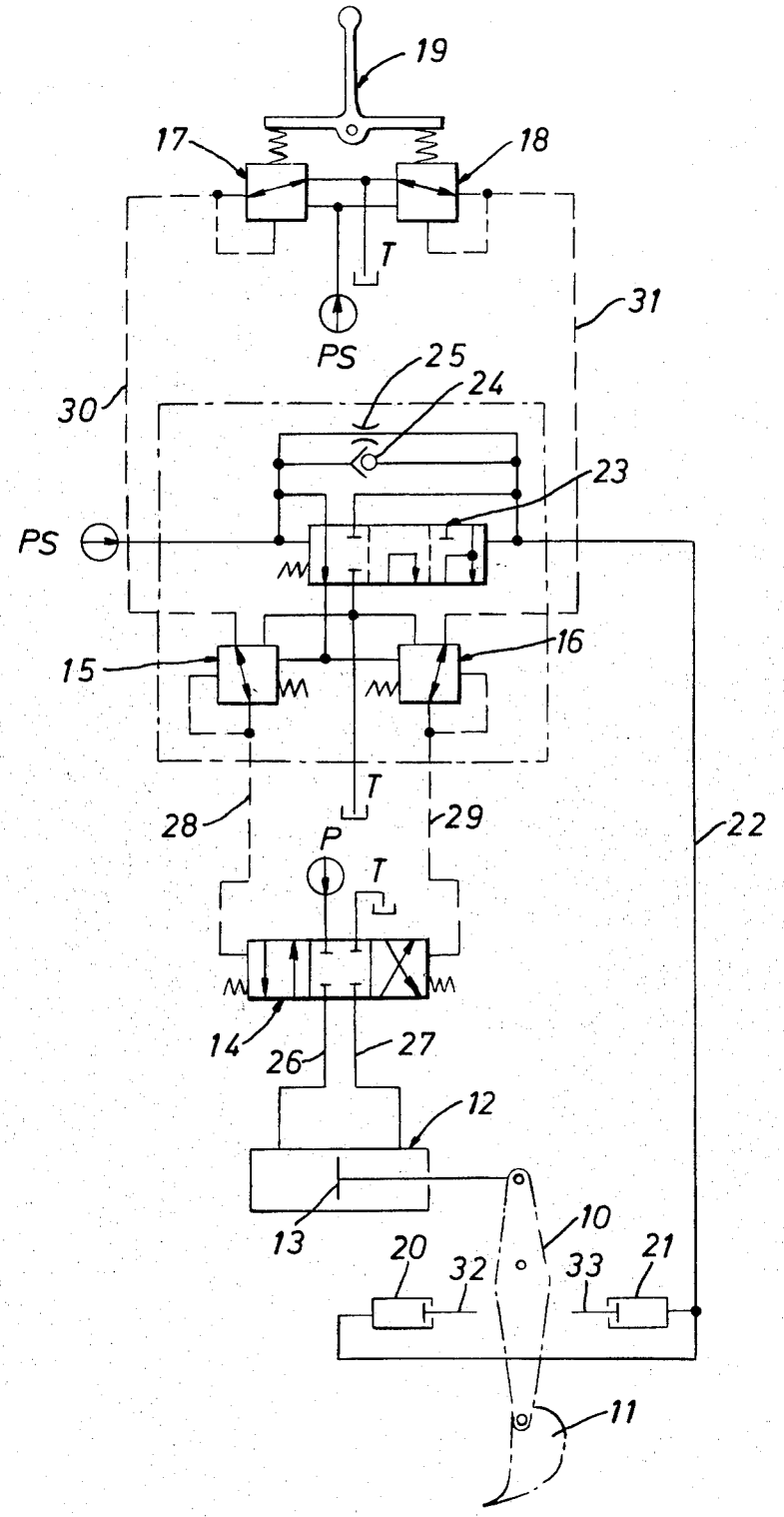
19
17
18
T
PS
31
30
25
24
23
PS
15
16
T
28
29
22
P
T
14
26
27
12
13
10
20
32
33
21
11

APPARATUS FOR RESTRICTING THE VELOCITY OF A HYDRAULIC PISTON IN ITS END POSITIONS

The present invention relates to an apparatus, in piston and cylinder units with a main valve which may be regulated by means of a servo-circuit, for restricting the velocity of movement of the piston of the unit, when the piston approaches at least its one extreme or end position.

In hydraulic excavators, the excavating movements of the boom, stick and bucket are produced by means of piston and cylinder units which act on a lever in each respective part. The power transmission medium, normally oil, is led under pressure to one end of a hydraulic cylinder and is emitted, at lower pressure, at the other end of the cylinder, or vice versa. The pressure and flow of the power transmission medium are realized in one or more pumps which are located in the upper region of the central machinery and are transmitted by means of conduits to each respective cylinder. When the machine is working, the operator activates, by means of control levers, the various flows to the hydraulic cylinders and thereby produces the desired movement of the excavating assembly. In order to obtain the contemplated flow distribution, there is provided, in the central machinery, a number of main valves which may, by means of servo-circuits, be adjusted by the assistance of control pressure valves located in the operator's cab.

When the piston and cylinder units are in operation, the piston will, at the end of a working movement, often strike the bottom of the cylinder, as a result of which an abrupt braking of all of those details which are in movement (for example the stick and bucket of the excavator and possibly also the load carried in the bucket) will take place. Clearly, when such great masses which are in movement are rapidly brought to a halt, great forces occur which are concentrated to the piston and cylinder unit proper and its bearings, as well as to the fittings on which the piston and cylinder unit is mounted. If the piston often strikes against the cylinder bottom in this manner, damage will soon occur to the machine parts involved.

It is known in the art to provide hydraulic cylinders with inner damping devices, in which a throttling of the outgoing oil flow takes place before the cylinder parts reach the end position. The disadvantage inherent in such a type of damping is that a very small amount of oil is subjected to the throttle effect and is thereby heated by the energy absorption, which may result in oil damage and in seizing of the details included in the throttle device. Moreover, the cylinder length must be increased by that amount of space which is required for the damping device in each respective cylinder end. It is also known in the art to connect an operating device to the piston rod of the piston and cylinder unit and place regulating means in the path of movement of the operating device, the regulating means being actuated when the piston is at a predetermined distance from its end positions. The main valve is acted upon by these regulating means for the purposes of throttling the pressure medium supply to the main valve. Arrangements of this type function unsatisfactorily in practice and have never enjoyed any great success.

The major object of the present invention is to realize a simple damping apparatus which, however, functions more reliably than those devices described above. This object is achieved in that a hydraulic sensor is secured to one of the machine parts which may be moved with respect to each other by means of the piston and cylinder unit, the hydraulic sensor having a freely protruding piston rod directed towards the second machine part, this piston rod, when the piston of the piston cylinder unit approaches its end position, striking the second machine part or an actuating device secured thereon, and projecting the piston of the hydraulic sensor into the cylinder in order therein to establish a pressure which exceeds the pressure in the servo-circuit; and that a valve is arranged to sense the pressure difference between the servo-pressure and the pressure established in the cylinder of the hydraulic sensor and, in accordance therewith, to actuate the main cylinder such that this throttles the supply of pressure medium to the operating cylinder.

The invention will described in greater detail below with reference to the accompanying drawing which illustrates one embodiment of the invention in the form of a hydraulic coupling diagram.

In the coupling diagram shown on the drawing, an excavator stick 10 is intimated by means of dot dash lines and has a bucket 11 mounted thereon. The stick 10 is journaled in a conventional manner in a boom (not shown) and is operated by means of a piston and cylinder unit 12 which is protracted and retracted by means of the supply and the exhaust, respectively, of pressure medium by the intermediary of conduits 26, 27 which are connected to a main valve 14. On the drawing, the main valve 14 is located in a neutral, central position and it will be appreciated that it is possible, by actuating the main valve to the right or left, to connect the conduits 26, 27 to the pump or tank for shifting the piston 13 of the unit 12 in one or the other direction. The shifting of the main valve 14 is effected by means of a servo-circuit which is coupled by conduits 28, 29 to the main valve 14. The conduit 28 is connected to a throttle relief, valve 15 which in its turn is connected via a conduit 30 to a control pressure valve 17. The conduit 29 is coupled to a throttle relief valve 16 which is coupled to a control pressure valve 18 by the intermediary of a conduit 31. It will be apparent from the drawing that it is possible, by manually actuating a control lever 19, to cause a servo-pressure flow to run from the conduit extending to the servo-pump PS, by the intermediary of the control pressure valves, throttle relief valves and associated conduits, to the main valve 14 in order to realize a shifting of this valve in one or the other direction. The above-described arrangement is fully conventional and the piston and cylinder units for, for example the boom and stick are coupled in the same manner.

Two hydraulic piston and cylinder units 20, 21 are mounted on the boom (not shown), the units each having a freely projecting piston rod 32, 33, respectively. The hydraulic units 20, 21 are secured on the boom in such a manner that the piston rod 32 is actuated when the stick 10, on swinging, approaches its one limit position; whereas the piston rod 33 is actuated when the stick 10 approaches its other limit position. The skilled reader of the coupling diagram will appreciate that both of the hydraulic units 20, 21 are coupled, by the intermediary of a conduit 22 and a non-return valve 24 to the servo-pump, that is to say servo-pressure prevails in the hydraulic units 20, 21, for which reason the piston rods 32, 33 are protracted. On approaching its limit positions, the stick 10 or the actuating device fixedly mounted thereon strikes the piston rod 32, 33, respectively, and projects the associated piston into the cylinder, and, as a result of the presence of the non-return valve 24, a pressure which exceeds the servo-pressure will be established in the cylinder. The conduit 22 is also connected to a pressure difference sensing valve 23 which is normally held in the position shown on the drawing by the servo-pressure, that is to say when an operating hydraulic unit 12 is working. The conduit 22, which is coupled to the servo-pump PS by the intermediary of the non-return valve 24 and possibly a throttle 25, is connected to the sensing valve 23 in such a manner that the pressure therein acts against the servo-pressure and, since the former, on actuating of the hydraulic units 20, 21, is greater than the latter, the sensing valve 23 will be switched, with the result that the servo-pressure in the throttle relief valves 15, 16 is throttled. Thereby, the main valve 14 is also caused to assume an intermediate position, that is to say the velocity of movement of the piston 13 in the operating hydraulic unit 12 is reliably reduced before the piston reaches the cylinder bottom. As depicted in the drawing figure fluid pressure acting on each valve is opposed by spring pressure to move the valves in response thereto.

By means of the present invention it is possible, as was described above, to realize in a very simple manner the desired velocity reduction of the piston movement in an operating cylinder, the apparatus according to the present invention having proved in tests to be very reliable. A further advantage in the apparatus according to the invention is that the piston may be driven to its end position. Since the throttle relief valves 15 and 16 may be placed within the basic machinery in association with the valve 14, the further advantage will be gained that no time lags occur as a result of the flow losses which arise in the event of long distances to the cylinder of the operating hydraulic unit, and in the event of low operating temperatures.

The device according to the present invention is primarily intended for excavators and the like, but may, naturally, also be used within other fields of application for operating hydraulic units which are subjected to corresponding stresses and strains.

What I claim and desire to secure by Letters Patent is:

1. In a hydraulic excavator, an apparatus for restricting the movement of a piston of an operating hydraulic unit, when said piston approaches at least its one end position in a cylinder, comprising:

the operating hydraulic unit coupled between two excavator parts which are movable with respect to each other by means of the operating hydraulic unit;

a main valve which is coupled to the operating hydraulic unit in orner to be actuated by a first pressure medium supplied thereto;

a servo-circuit for regulating the main valve having an associated servo-pressure therein;

a hydraulic piston-cylinder sensor is secured to one of the excavator parts and has a freely projecting piston rod directed towards the second of the excavator parts; and a pressure difference sensing valve which is coupled between said hydraulic piston-cylinder sensor and main valve;

a pressure provided in said hydraulic piston-cylinder sensor when the piston of the operating hydraulic unit approaches its end position, in that said piston rod of said hydraulic piston-cylinder sensor mounted on the one excavator part is actuated by the second excavator part, said pressure exceeds the servo-pressure, and said pressure difference sensing valve sensing the pressure difference between said pressure in said piston-cylinder sensor and the servo-pressure and, in accordance therewith, throttle valve means between said pressure difference sensing valve and main valve for throttling said first pressure medium supplied to the main valve such that a second pressure medium supplied the main valve to the operating hydraulic unit is throttled.

2. The apparatus as recited in claim 1 wherein a non-return valve is interposed between said hydraulic sensor cylinder-piston and the servo-circuit in parallel to said pressure difference sensing valve, said pressure in the servo-circuit being constant throughout until said hydraulic sensor cylinder-piston is contacted by the one of the excavator parts.

3. The apparatus as recited in claim 2 further including a throttle disposed in parallel to said non-return valve to assure uniform servo-circuit pressure prior to the resultant pressure increase.

* * * * *